United States Patent [19]

Defibaugh et al.

[11] Patent Number: 5,007,862

[45] Date of Patent: Apr. 16, 1991

[54] SHIELDED CONNECTOR HAVING A MULTIPLY ORIENTABLE HOUSING

[75] Inventors: George R. Defibaugh, Mechanicsburg; Earl C. Myers, Jr., Harrisburg; Steven G. Smith, Linglestown, all of Pa.

[73] Assignee: AMP Incorporated, Harrisburg, Pa.

[21] Appl. No.: 540,678

[22] Filed: Jun. 15, 1990

[51] Int. Cl.[5] ..... H01R 13/648

[52] U.S. Cl. ..... 439/607; 439/56

[58] Field of Search ..... 439/56, 58, 607, 609, 439/610

[56] References Cited

U.S. PATENT DOCUMENTS

| | | | |
|---|---|---|---|
| 2,742,627 | 4/1956 | Lazzery | 439/56 |
| 4,637,669 | 1/1987 | Tajima | 439/609 |
| 4,913,664 | 4/1990 | Dixon et al. | 439/607 |

*Primary Examiner*—Joseph H. McGlynn
*Assistant Examiner*—Hien D. Vu
*Attorney, Agent, or Firm*—David L. Smith

[57] ABSTRACT

A circular cross section dielectric housing (4) of a circular DIN shielded electrical connector (2, 2') for mounting in a vertical position on a circuit board, is provided on its bottom face (16) with angular orienting lugs (54). An outer shield (10) which defines a circular seat for the dielectric housing (4) has a bottom wall (106) defining a hole (108) for receiving contact tails (44) on electrical terminals (12) in the housing (4). The bottom wall (106) of the shield (110) has notches (122, 124) therein for receiving the orienting lugs (54). The angular orientation of the housing (4) with respect to the shield (10) can be selected by aligning each lug (54) with a chosen notch (122, 124) in the bottom wall (106) of the shield when assembling the housing (4) to the shield (10).

17 Claims, 7 Drawing Sheets

72
X
72
70
8
68
92
72
74
74
86
88
84
80
78
40
14
82
78
76
2
18
34
39
36
18
37
32
26
50
38
37
52
4
52
52
52
16
54
54
96
10
104
110
106
116
122
116
120'
124
124
100
120
102
98
108
122
120
94
121
40
40
42
12
46
41
42
46
44
X
44

SHIELDED CONNECTOR HAVING A MULTIPLY ORIENTABLE HOUSING

BACKGROUND OF THE INVENTION

This invention relates to shielded electrical connectors for mounting in a vertical position on a circuit board and in particular to Din connectors comprising a dielectric housing containing electrical terminals, which may for example be either receptacle terminals or plug terminals and at least an outer shield for the housing. Since such a connector is fixedly mounted to the circuit board, the problem arises of angularly orienting the housing with respect to the outer shield, before the connector is mounted to the board, in order to ensure that the terminals are correctly oriented for mating with those of the mating connector. Since the housing is usually provided with polarizing keying means, such means must also be properly angularly oriented so as to be compatible with those of the mating connector.

There are disclosed in U.S. Pat. No. 4,611,878 and U.S. Pat. No. 4,637,669, shielded electrical connectors having circular cross section dielectric housings having axially extending cavities in which electrical terminals are secured and being surrounded by an outer metal shield, the housing being constructed for mounting on the surface of a circuit board and the terminals having contact tails extending therefrom for connection to electrical circuitry on the board. In each case, however, the axis of the circular cross section housing extends parallel to the circuit board and the mating connector is attached to a flexible lead, and is, therefore, not fixedly mounted, so that the angular orientation problem mentioned above, does not arise.

SUMMARY OF THE INVENTION

According to the present invention, the dielectric housing is provided on its lower face, that is to say its face which lies proximate to the circuit board when the connector has been mounted thereon, with at least one housing orienting lug, the outer metal shield being in the form of a bowl for receiving the dielectric: housing with its lower end leading, the bowl having a bottom wall defining central hole through which the contact tails of the terminals pass when the housing is inserted into the outer shield The bottom wall is formed with a plurality of openings which are spaced about its periphery and in which the orienting lug or one of the orienting lugs is selectively engagable in order to select the angular orientation of the dielectric housing with respect to the outer metal shield. Thus, before inserting the housing into the shield, it is angularly oriented with respect thereto to align the, or each, orienting lug with a chosen one of the openings in the bottom wall of the outer shield, so that the connector is compatible for mating with a mating connector which is likewise fixedly positioned when the connectors have been mounted to equipment.

The number of different angular orientations in which the dielectric housing can be positioned in relation to the outer metal shield will depend upon the number of openings that are provided in the bottom wall thereof.

For augmented shielding, the connector is preferably provided with an inner shield which is received in a chamber defined by the dielectric housing, the inner shield having at least one spring arm extending through the hole in the bottom wall of the outer shield for connection to a ground conductor on the circuit board. The openings in the bottom wall may be in the form of notches debouching into the said central hole and soldering tab extending from the base of one or more of the notches, also for connection to a ground conductor on the circuit board. The, or each, spring arm may extend through an internally metal plated hole in the board and the, or each, solder tab may be arranged to urge the spring arm, or a respective spring arm against the metal plating in the hole in the circuit board.

The outer shield will normally be secured for example, by means of a fastener to the circuit board the housing resting on the bottom wall of the outer shield and the orienting lugs serving to stand the housing off from the board.

DESCRIPTION OF THE PREFERRED EMBODIMENT

Figure 1:
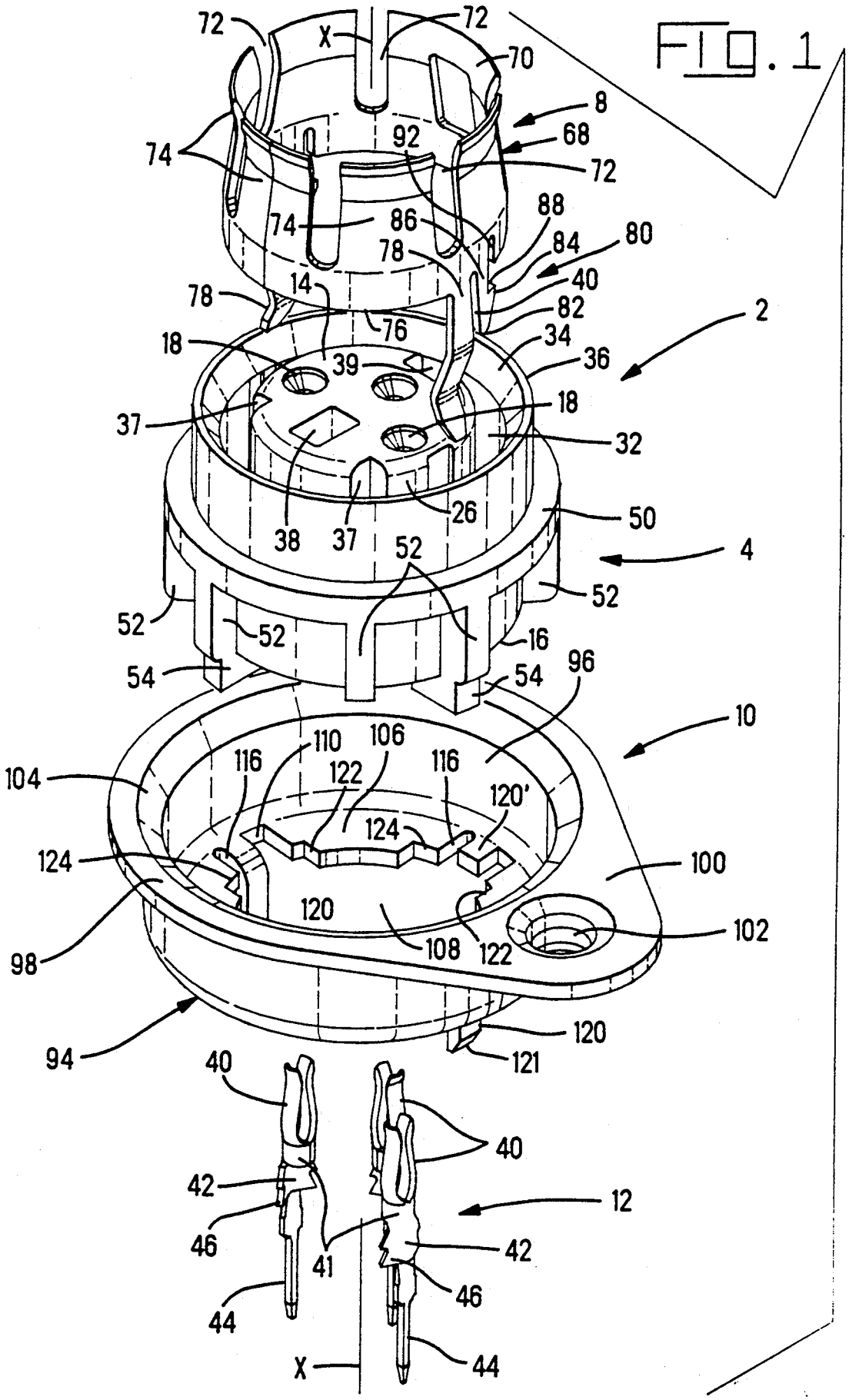
FIG. 1 is an exploded, isometric view of a three position shielded circular DIN electrical receptacle connector for vertical mounting on a printed circuit board and comprising a dielectric housing receiving electrical terminals, a metal inner shield and a metal outer shield.

As best seen in FIG. 1, a three position, circular cross section DIN shielded electrical receptacle connector 2 for vertical mounting on a printed circuit board, comprises a one piece dielectric housing 4, an inner shield 8, an outer shield 10, and three electrical receptacle terminals 12.

Figure 5:
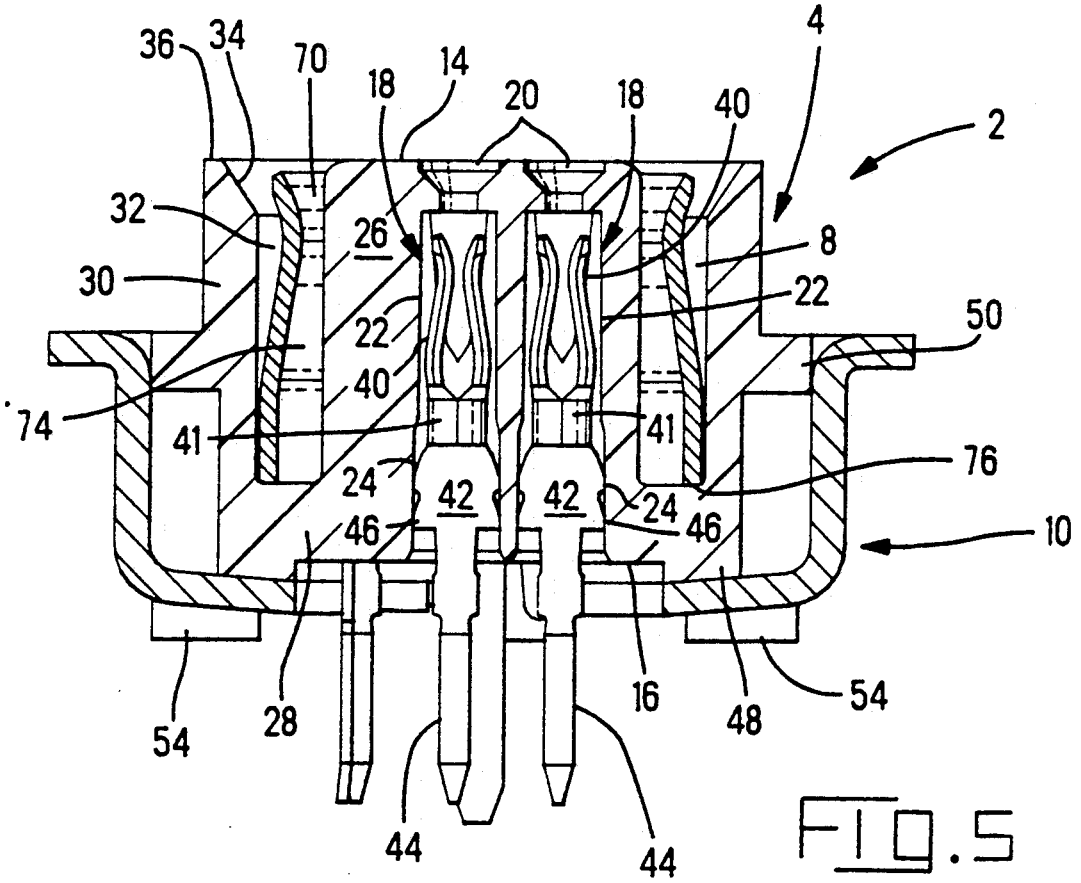
FIG. 5 is a sectional view taken on the lines 5—5 of FIG. 3.
Figure 6:
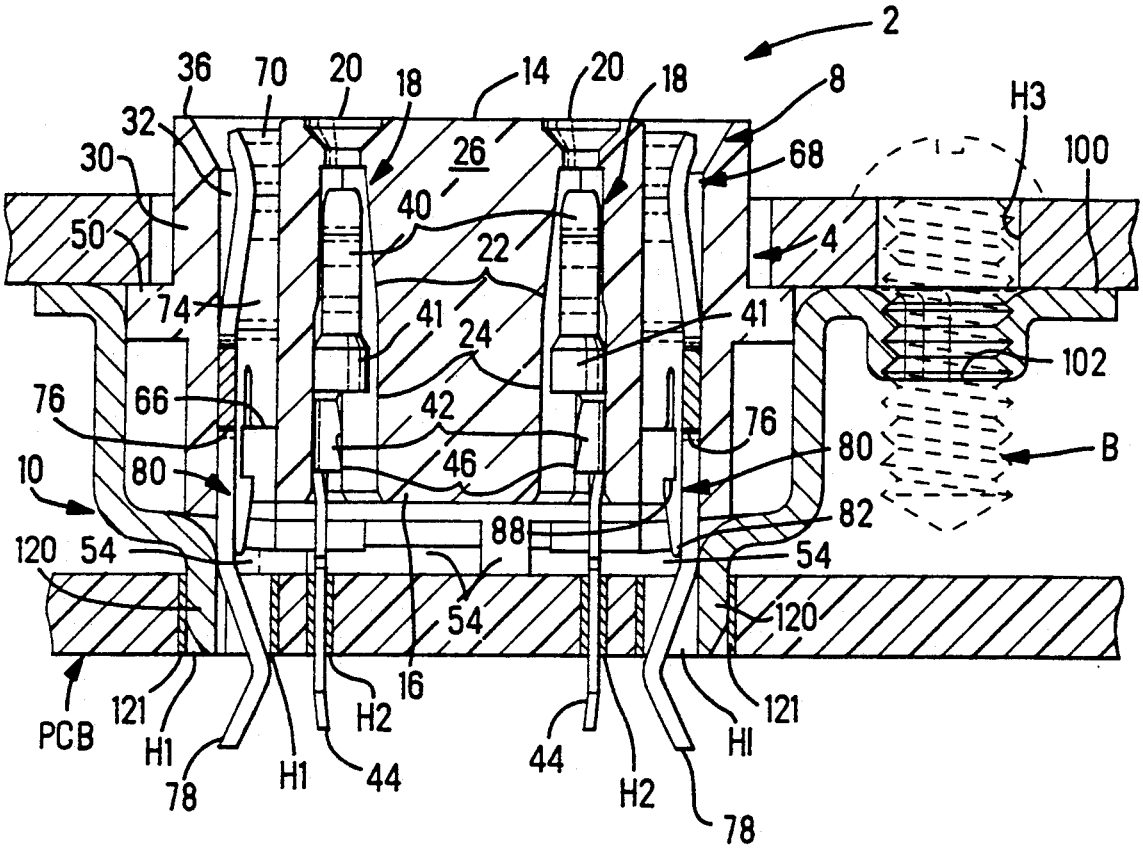
FIG. 6 is a sectional view taken on the lines 6—6 of FIG. 3 showing the connector, when vertically surface mounted on a printed circuit board.

The housing 4 which is of overall circular cross section, has a mating end face 14 and opposite thereto a terminal receiving end face 16 and is formed with three parallel, terminal receiving cavities 18 extended axially of the housing 4 and being spaced from each other about its longitudinally axis X. As best seen in FIGS. 5 and 6, each cavity 18 has an upwardly flared pin guiding mouth 20 opening into the mating face 14 and which communicates with a cylindrical upper cavity portion 22 in turn communicating with a substantially D-cross section lower cavity portion 24 of larger cross sectional area than the portion 22 and which opens into the terminal receiving face 16. The cavities 18 are formed in block 26 of the housing 4, which in the preferred embodiment has a radially central, overall circular cross section. The block 26 projects from a base 28 from which upstands an outer hood 30 coaxial with, and spaced from, the block 26 to define a circular inner shield receiving chamber 32 in co-operation therewith. The hood 30 has an outwardly flared mouth 34 an outer edge 36 of which is flush with the mating face 14. There extends through the central block 26 and the base 28, a rectangular cross section guide keyway 38. The block 26 is also formed with a polarizing features 37 and 39.

Each terminal 12 comprises a pin receptacle part 40, from a circular strap 41 of which extends a channel-shaped retention part 42 from which in turn extends a rectangular cross section contact tail 44. In order to load the housing 4 with terminals 12, each terminal 12 is inserted into a respective cavity 18, by way of the terminal receiving face 16, with its receptacle part 40 leading, so that the latter is received in the upper portion 22 of the cavity 18, the retention part 42 of the terminal 12 being forced into the lower portion 24 of the cavity 18, so that serrations 46 on the part 42 bite into the wall of the cavity portion 24 so as to retain the terminal 12 in its cavity 18, as best seen in FIGS. 5 and 6. In this fully inserted position of the terminal 12, the tail 44 thereof projects below the face 16, substantially normally thereof.

The base 28 has on its underside a raised peripheral rim 48, the hood 30 having substantially mid way between its ends, an external peripheral rib 50 from which extend axially of the hood 30, eight parallel, radially outwardly projecting and circumferentially spaced ribs 52. There depends from the rim 48 and from each of four of the ribs 52 at regularly spaced positions about the rim 48, a stand off and orienting lug 54, the lugs 54 being of equal height.

Figure 3:
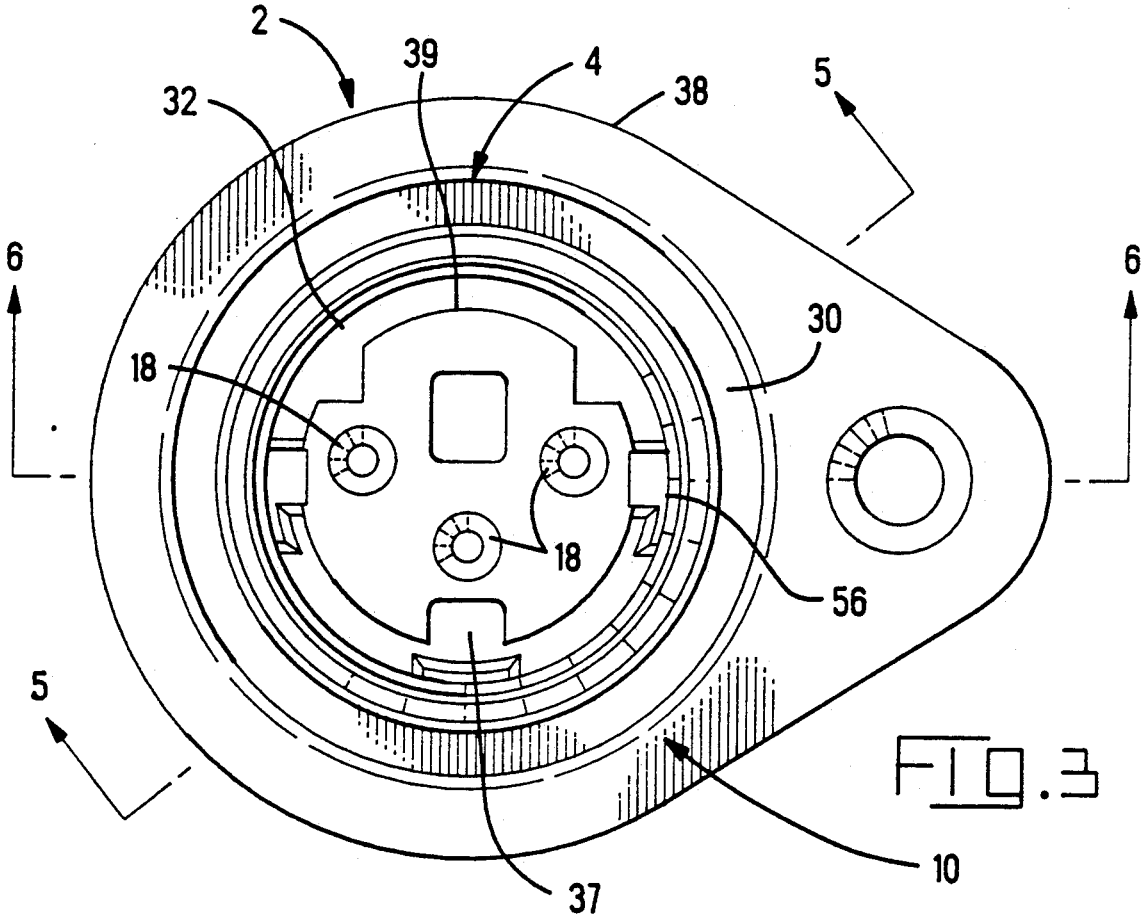
FIG. 3 is a top plan view of the connector.
Figure 4:
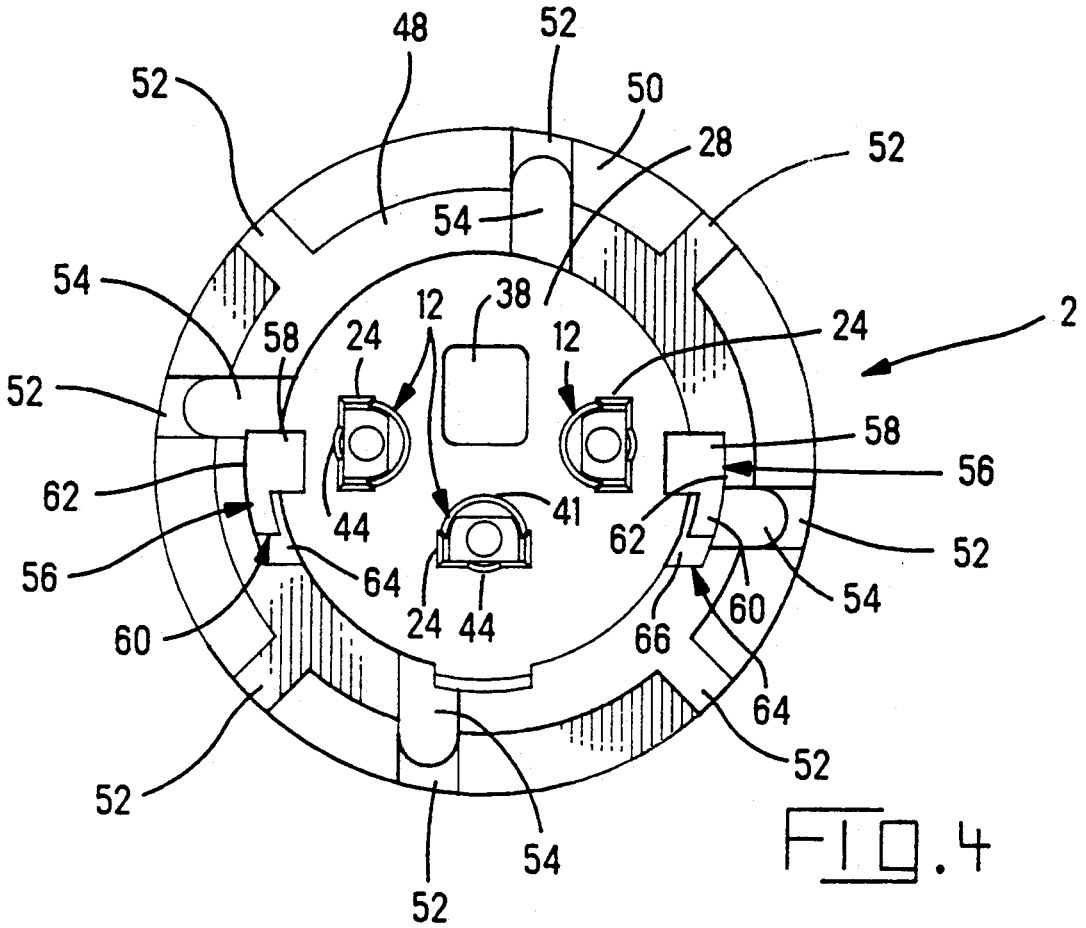
FIG. 4 is a bottom plan view of the dielectric housing.
Figure 7:
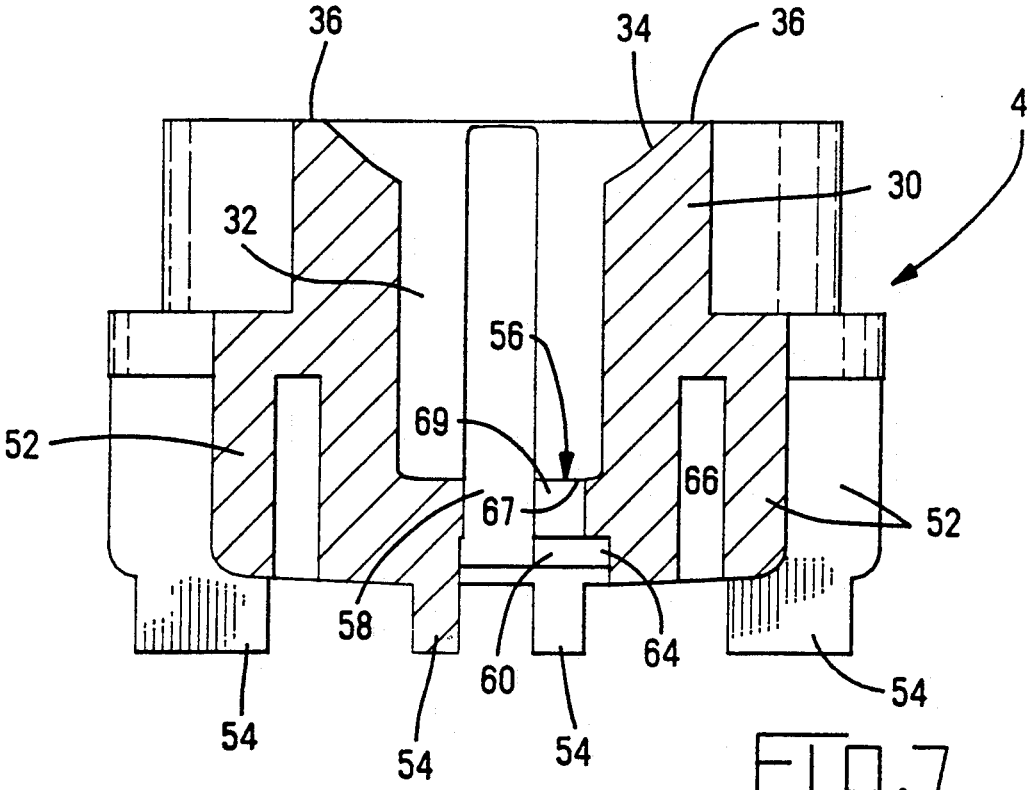
FIG. 7 is a side view of the dielectric housing shown partly in section.

There are formed in the base 28 of the housing 4, on opposite sides of the block 26, two diametrically opposed, through slots 56, which, as best seen in FIGS. 3 and 4, (that is to say both from above and below the base 28) are substantially L-shaped, each having a larger area part 58 and extending therefrom a smaller area part 60. The parts 58 and 60 are, as best seen in FIG. 4, of substantially rectangular, but have a common arcuate side 62 of substantially the same radius as rim 48. As best seen in FIG. 7, each slot 56 is also substantially L-shaped as seen in cross section through the base 28. The radially outer portion of the part 58 of each slot 56 extends into the rim 48, the whole of the part 60 thereof lying within the confines of the rim 48 and communicating with a notch 64 in the rim 48, which notch may be regarded as a shallow extension of the part 60, and the base of which constitutes a latching shoulder 66, which is best seen in FIG. 7. Between the shoulder 66 and the upper surface 67 of the base 28, the base 28 defines an arcuate abutment surface 69.

Figure 9:
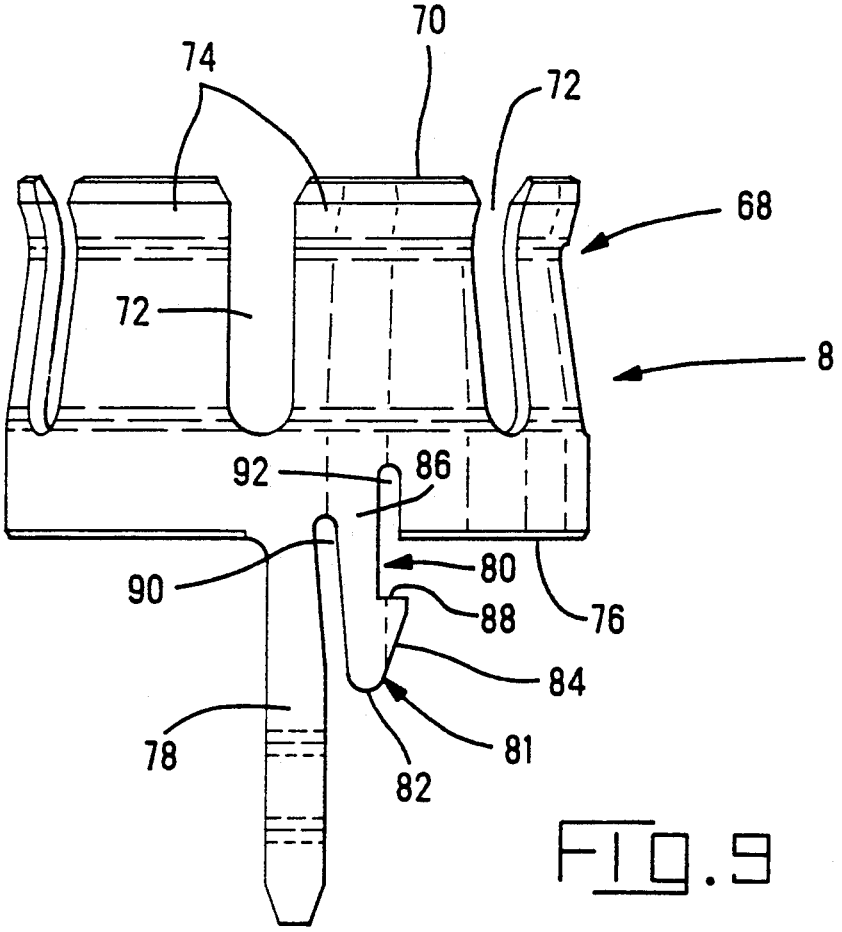
FIG. 9 is a side view of the metal inner shield.
Figure 10A:
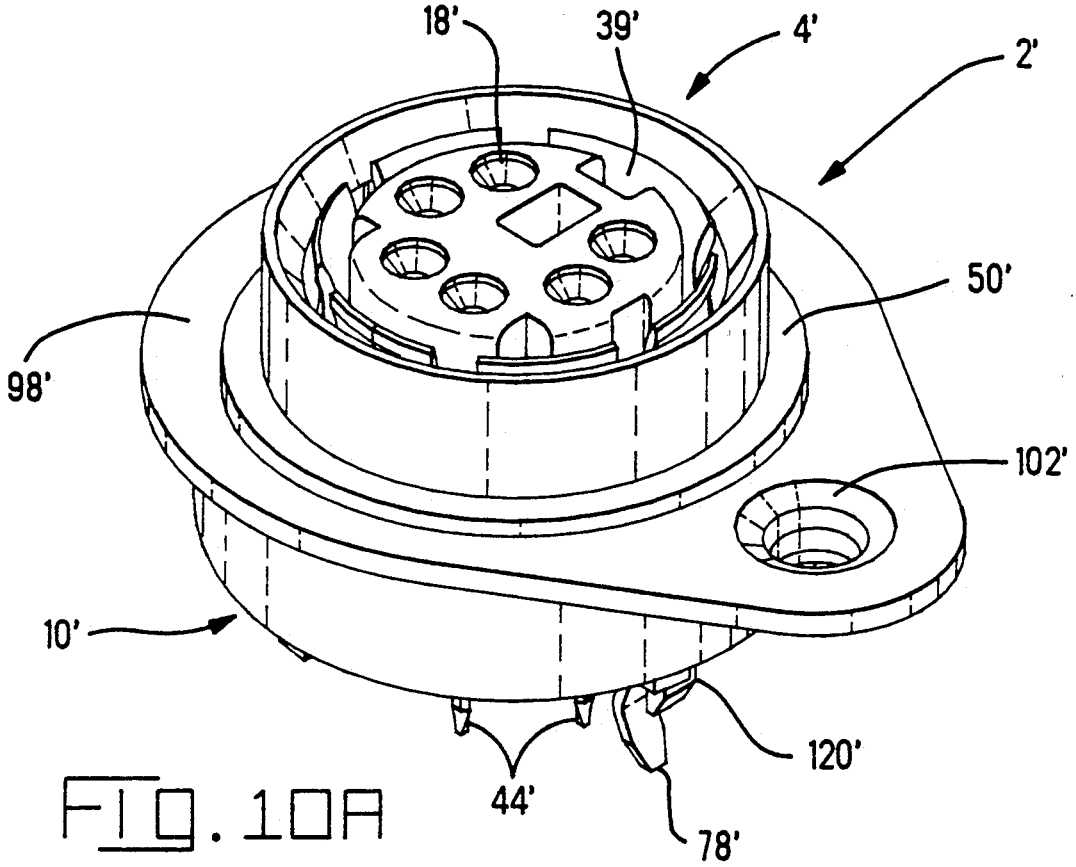
FIGS. 10A to 10D are isometric views of a connector which is otherwise of identical construction to that of FIGS. 1 to 9 but in which the dielectric housing has six terminal receiving positions, FIGS. 10A to 10D showing the dielectric housing located in four respective angular orientations with respect to the outer metal shield of the connector.
Figure 10B:
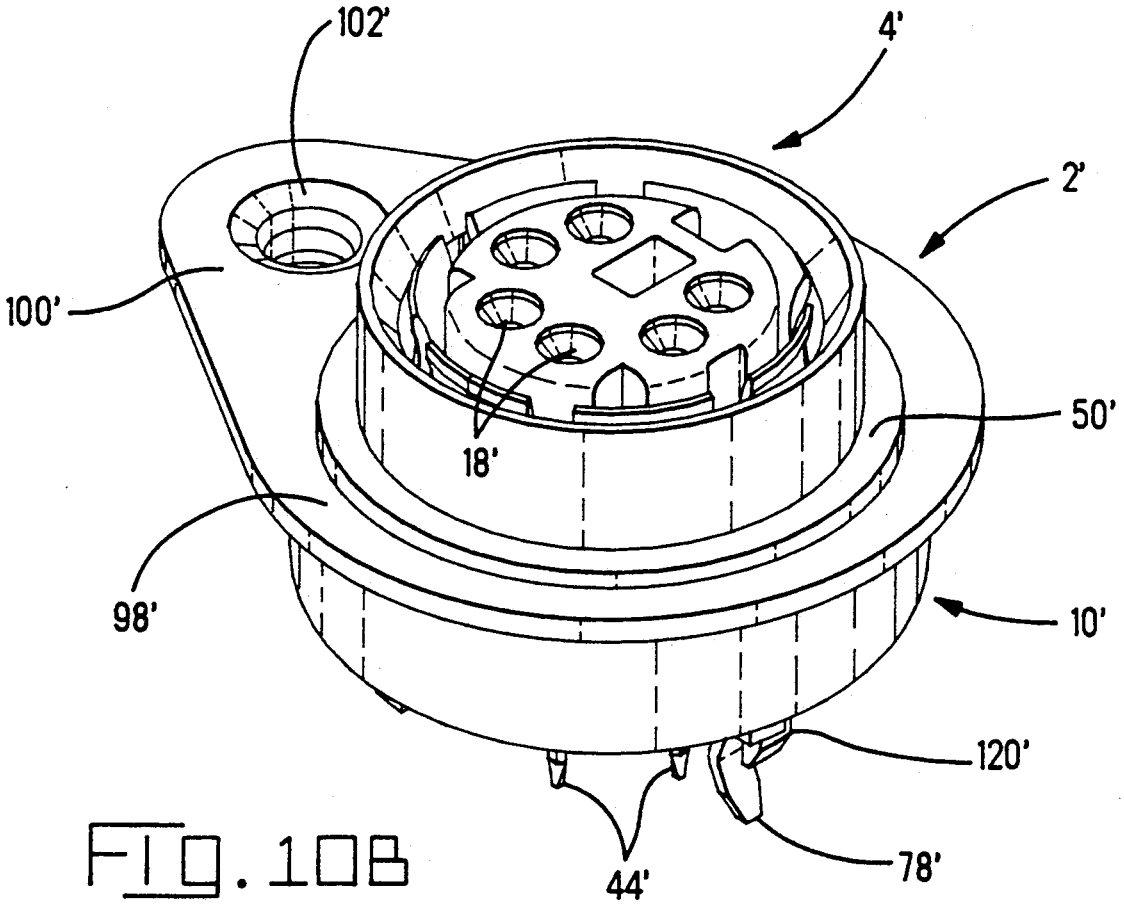
Figure 10C:
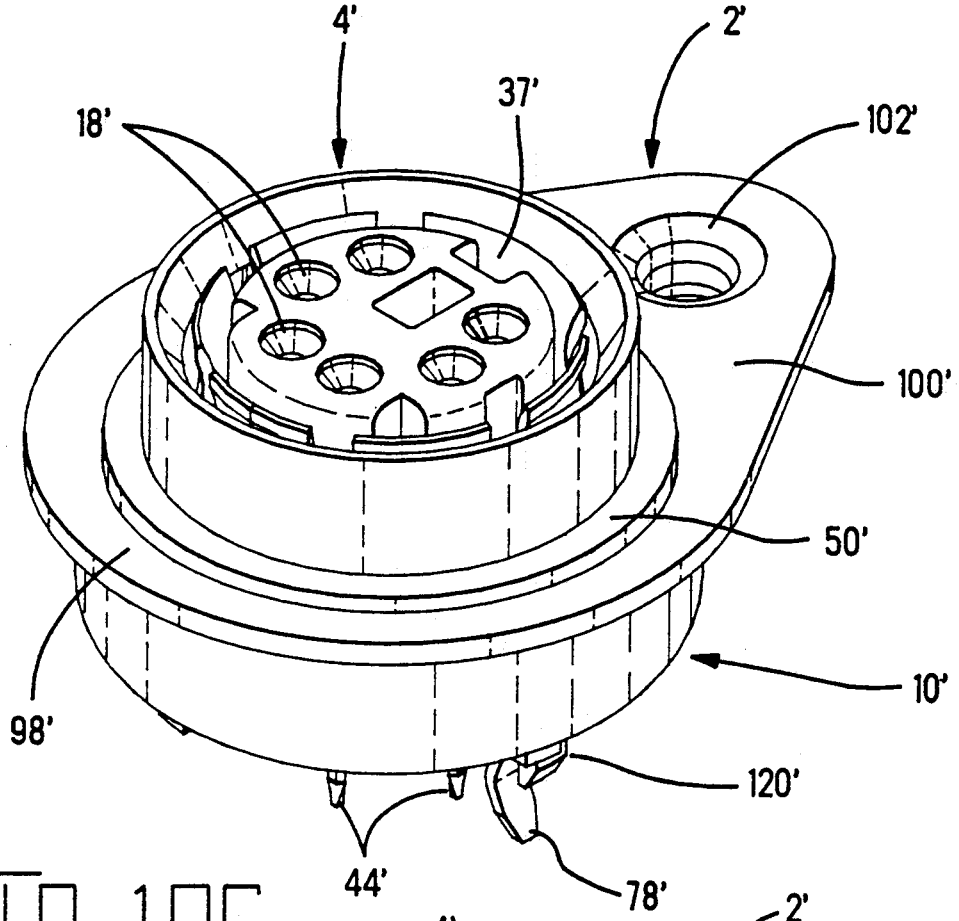
Figure 10D:
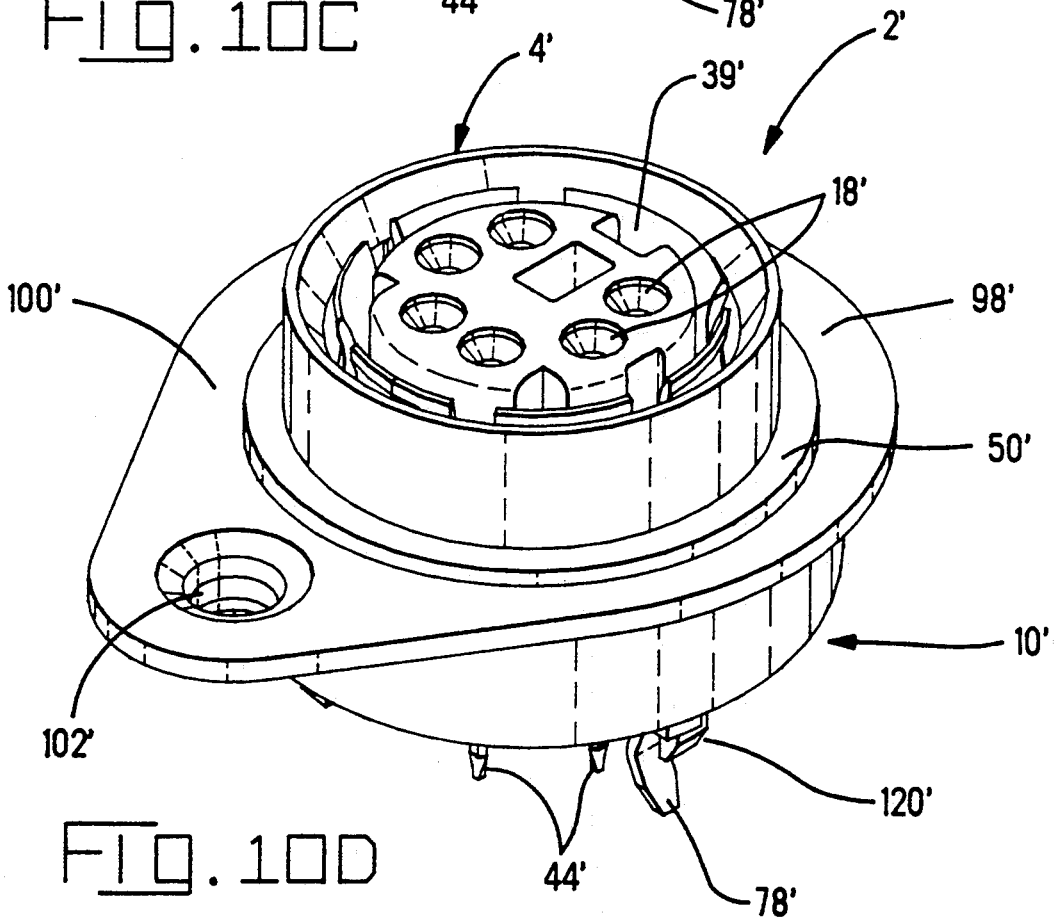

The inner shield 8 which is typically stamped and formed from a single piece of sheet metal stock, comprises as best seen in FIGS. 1, 6 and 9, circular annular body 68 having a radiused mating upper edge 70 from which extends downwardly slots 72 defining a crown of resilient fingers 74. The body 68 has a lower edge 76 from which depend, at diametrically opposite positions, two cantilever spring contact arms 78, and adjacent to each arm 78, a uniplanar, cantilever, barbed, latch arm 80. Each latch arm 80, which has been stamped from said sheet metal stock but which has not otherwise been formed, has, a head 81, having a rounded free end 82. An edge 84 on the side of the head 81 remote from the adjacent arm 78 diverges away therefrom and, towards the edge 76 to define in co-operation with a stem 86 of the latch arm 80, a latching shoulder 88 extending transversely of the stem 86. By virtue of a slot 90 separating the arms 78 and 80, and a slot 92 opening into the edge 76 on the other side of the arm 80, from the slot 90 and defining part of the stem 86, the stem 86 is stiffly and resiliently flexible in its own plane, towards and away from the arm 78.

Figure 2:
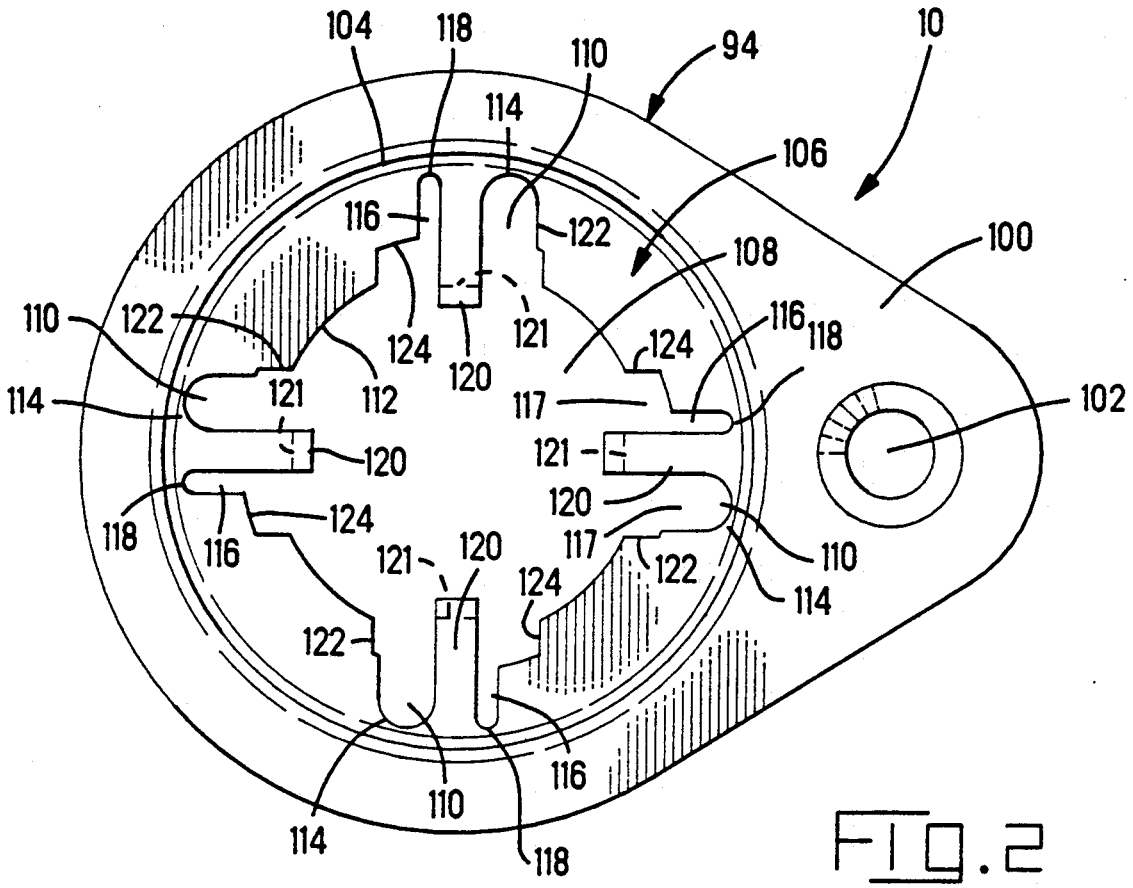
FIG. 2 is a top plan view of the outer shield before it has been prepared for mounting to the dielectric housing.

The outer shield 10 which may be drawn or stamped and formed from a single piece of metal stock, comprises as best seen in FIGS. 1 and 2, a bowl-shaped circular, annular body 94 having a circular side wall 96 surmounted by a radially outwardly extending upper rim 98 from which projects a mounting ear 100 having a through tapped opening 102 therein. The radially inner part of the rim 98 defines an upwardly flared guiding mouth 104. The body 94 has a rudimentary bottom wall 106 defining a central hole 108.

FIG. 2 shows the shield 10 before it has been prepared for assembly to the housing 4. As shown in FIG. 2, the wall 106 has four slots 110 spaced about its inner periphery 112 at regular intervals, each having an outwardly convex base 114. The wall 106 is also formed with four slots 116 each juxtaposed with a respective slot 110 and having an outwardly convex base 118. The radially outer part of each slot 110 is wider than the radially outer part of each slot 118. Each slot 110 and 118 has an enlarged, radially inner mouth 117, all of the mouths 117 being of substantially equal width. The mouth 117 of each slot 110 is provided by a smaller notch 122 in the Wall 106, the mouth 117 of each slot 118, being provided by a larger notch 124 in the wall 106. Notches 122 and 124 are clearance for inner shell head 81. Between each pair of adjacent slots 110 and 116 is a radially inwardly projecting soldering tab 120, the underside of which has a chamfered free end portion 121. It may be said that each pair of slots in fact constitutes a common notch from the base of which the soldering tab projects.

Before the shield 10, as it is shown in FIG. 2, is assembled to the housing 4, two diametrically opposed ones of the tabs 120 are bent down, as will best be apparent from FIG. 1, to depend below the shield 110 and the two remaining tabs 120 are sheared off back from the mouths 117 to leave stubs 120'.

Figure 8:
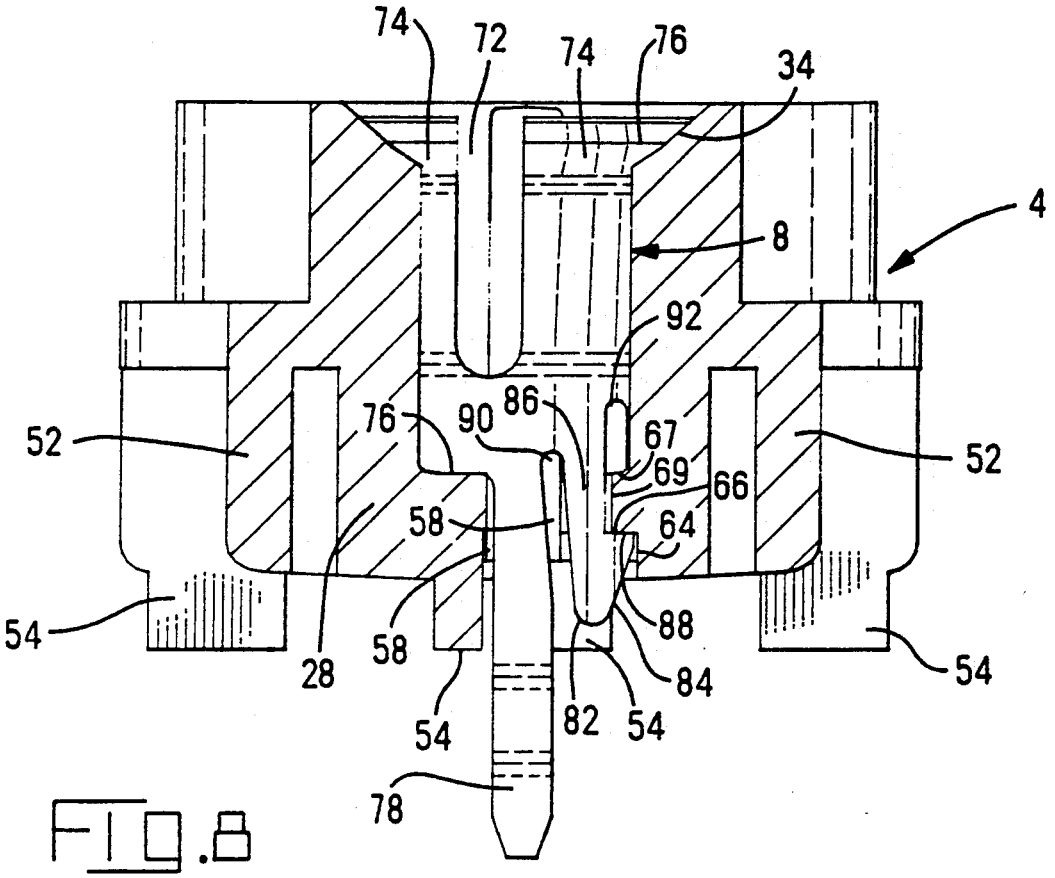
FIG. 8 is a similar view to that of FIG. 7 but showing the metal inner shield when assembled to the dielectric housing.

The manner in which the parts of the connector 2 are assembled, will now be described. The inner shield 8 is assembled to the housing 4, by inserting it, with the spring arms 78 leading, into the chamber 32 of the housing 4, guided by the flared mouth 34 of the hood 30, so that each arm 78 passes through the part 58 of a respective slot 56 until the edge 76 of the shield 8 bottoms on the base 28 of the housing 4, as best seen in FIG. 8, and the outer surface of the edge 70 of the shield 8 is spaced from the surface of the mouth 34. During the insertion of the shield 8, the inclined edge 84 of the head 81 of the latch arm 80, guided by its rounded end 82 engages the abutment surface 69 of the base 28 and is thereby cammed resiliently towards the adjacent spring arm 78 by flexure of the stem 86 until the shoulder 88 of the head 81 passes the latching shoulder 66, when the stem 86 instantly resiles so that the shoulder 88 engages under the shoulder 66 in latching relationship therewith, whereby the shield 8 is firmly latched against withdrawal from the housing 4 with the spring arms 78 projecting there beneath.

The housing 4 is then press fitted into the outer shield 10 which defines a circular seat therefor, the ribs 52 guided by the mouth 104 of the shield 8 engaging the inner face of the wall 96 of the shield 10, until the base 28 of the housing 4 bottoms against the rudimentary bottom wall 106 of the shield 10, the rib 50 engaging tightly against the interior of the shield 10, as best seen in FIGS. 5 and 6. For the press fitting operation, the housing 4 is so angularly oriented about the axis X—X with respect to the shield 10, that as the housing 4 approaches its fully inserted position in the shield 10, each of the lugs 54, passes through the opposed notches 110 and 122 of a respective pair thereof, to depend below the wall 106 when the housing 4 has been fully inserted into the shield 10.

Alternatively, the housing 4 could be initially assembled to the outer shield 10, the inner shield 8 being then assembled to the housing 4.

When the parts of the connector 2 have been assembled as described above, the connector 2 is mounted to a circuit board (PCB) as shown in FIG. 6 with the axis of the connector 2 extending vertically. In this surface mounted position of the connector 2, the spring arms 78 of the inner shield 4 and the bent down tabs 120 extend through large, internally metal plated holes H2 in the PCB, so that each tab 120 urges the adjacent spring arm 78 against the metal lining of the hole H1, the tails 44 of the terminals 12 extending through smaller, internally metal plated holes H2 in the PCB. Since the chamfered end portions 121 of the tabs 120 which have been bent down, are radially outwardly directed, the portions 121 serve to guide the tabs 120 into the holes H1. Connector 2 is secured to the PCB a soldering operation, for example a wave soldering operation in which the tabs 120 are to be soldered to ground conductors (not shown) on the PCB and the tails 44 to signal conductors (not shown) on the board. A bolt B, which is shown in broken lines in FIG. 6, is screwed into the tapped opening 102 in the mounting ear 100 of the shield 10 to establish a common ground between the panel and shield 10. The lugs 54 serve to stand the housing 4 off from the PCB so that the housing 4 is protected from damage by the soldering heat and to wash underneath the housing subsequent to soldering.

In use, the assembled and surfaced mounted connector 2 can be mated with a circular, shielded DIN pin connector (not shown) having projecting pins for mating with the receptacle part 4 of a respective terminal 12 of the connector 2 and a shield having a projecting portion for insertion between the fingers 74 and the block 26 of the connector 2. The mating DIN connector may, for example, be mounted on a further printed surface board to extend vertically therefrom.

In order to allow the connector 2 to be so mated, its housing 4 must be angularly positioned with respect to the shield 10 so that the terminals 12 are so angularly located as to be compatible with the angular location of the pins of said mating connector and the polarization features 37 and 39 and the key 38 are angularly located so as to be compatible with the angular location of corresponding keying means of the mating connector. By virtue of the provision of the lugs 54 and the pairs of opposed notches 122 and 124, said lugs and said pairs of notches being four in number, the housing 4 can be mated for discrete angular positions with respect to the outer shield 10 by selecting the particular lug 54 which is to be inserted into each pair of opposed notches 120 and 122, by appropriately angularly positioning the housing 4 with respect to the shield 10 prior to its insertion thereinto.

FIGS. 10A to 10D show by way of example a six position connector 2' which is constructed in exactly the same way as the connector 2 except for the number of terminal receiving cavities, and the parts of which bear the same reference numerals as those used in FIGS. 1 to 9 but with the addition of a prime symbol. Each of FIGS. 10A to 10D shows the housing 4' in a respective one of four different angular orientation with respect to the outer shield 10'.

In practice, the dielectric housing will usually have between three and eight terminal receiving cavities.

By virtue of the construction of the inner shield, the latch arms are robust and are easily produced by a simple stamping operation as the inner shield is being made by progressive die forming. Since the stems off the latch arms are stiffly resilient in their own planes, their latching action is positive and thus completely reliable, this being of particular advantage since the inner shield may be subjected to some tensile stress when the shield of the mating connector is withdrawn therefrom.

While the preferred embodiment has been described with respect to specific features, orienting the connector housing in any one of several orientations within a shield can be achieved by features on the housing repeated at regular intervals around an axis of rotation. A symmetrical protrusion, or protrusions that collectively form a symmetrical protrusion, on the housing receivable in a corresponding symmetrical aperture or recess in the shield to provide multiple orientations of the housing relative to the shield. The housing opening would typically have features repeated therearound at regular intervals such that when the connector housing is rotated about the center point of the repeated features the protrusion is cooperable with the aperture or recess in multiple relative orientations. A rectangular aperture would provide two orientations; an equilateral triangle would provide three orientations; a square would provide four orientations, etc. Of course, the features herein described as being on the connector housing could be on the shield with complementary structure on the housing to achieve the multiple orientation capability.

We claim:

1. A circular cross section electrical connector for mounting in a position on a circuit board, the connector comprising;

a dielectric housing having a mating first end face and a second end face opposite thereto, a plurality of electrical terminal receiving cavities each opening into both of said faces and at least one housing orienting lug projecting from said second end face proximate to the radially outer periphery thereof;

an electrical terminal retained in each cavity and having a contact tail projecting from said second end face substantially normally thereof for insertion into a hole in the circuit board and a mating portion extending in the opposite direction to said tail; and an outer metal shield having a peripheral wall defining a seat for receiving said housing with said second face thereof leading, a rudimentary wall projecting radially inwardly from the peripheral wall and defining a central hole for the passage of said contact tails therethrough, a plurality of openings being distributed in spaced relationship circumferentially of said rudimentary wall, in each of which openings said at least one orienting lug is selective engagable in order- to select the angular orientation of said dielectric housing with respect to said outer metal shield.

2. A connector as claimed in claim 1, wherein a plurality of housing orienting lugs is provided on said second face, being evenly distributed about the periphery thereof, the number of said openings in said rudimentary wall being equal to the number of said lugs, and said lugs being of equal height.

3. A connector as claimed in claim 1, wherein each of said openings is in the form of a notch communicating with the inner periphery of said rudimentary wall.

4. A connector as claimed in claim 1, wherein the outer shield further comprises a radially projecting lug for receiving a fastener to secure the outer shield to a panel.

5. A connector as claimed in claim 3, wherein the dielectric housing further comprises means defining a chamber surrounding said cavities and an inner metal shield seated in said chamber, a spring arm projecting from the inner shield depending from said second face of the dielectric housing for insertion through one of said notches and through a further hole in the circuit board, there depending from a base of that notch, an elongate soldering tab for insertion into said further hole and for urging the spring arm radially inwardly of the connector.

6. A connector as claimed in claim 5, wherein a free end portion of said tab is chamfered on its radially outer side.

7. A connector as claimed in claim 1, wherein the dielectric housing is formed with a plurality of axially extending, and radially projecting, ribs evenly distributed about its outer periphery, for force fitting against the internal surface of said peripheral wall of the outer metal shield, said at least one orienting lug being aligned with and integrally formed with, an end of one of said ribs.

8. A connector as claimed in claim 7, wherein each rib has an end face which is flush with said second end face of the dielectric housing, for bottoming on the rudimentary wall of the outer shield, each rib merging with a peripheral rib extending about the dielectric housing for abutment with a flared mouth of the outer shield.

9. A circular cross section, shielded electrical connector for mounting on a surface of a circuit board to extend vertically therefrom, the connector comprising;

an overall circular cross section dielectric housing comprising a central, circular cross section block having a mating face, a hood surrounding the central block in spaced relationship therewith and a base connecting the hood to the central block and having an upper face within the hood and a lower face opposite to said upper face, the base being formed with a plurality of through slots opening into both said upper and lower faces, a plurality of electrical terminal receiving cavities in the central block extending axially thereof and opening both into said mating face and into said lower face of the base;

a circular, annular inner shield disposed between the central block and the hood and having a edge adjacent to the inner face of the base, and a pair of spring arms connected to said adjacent edge and extending through said slots and projecting from said outer face of the base;

a plurality of electrical terminals each retained in a respective one said cavities and each having a contact tail projecting from the lower face of the base, and a mating part extending in the opposite direction to said tail; and an outer metal shield defining a circular seat surrounding the dielectric housing and having a bottom wall defining a central opening through which said contact tails and said spring arms extend, the bottom wall having a plurality of openings therein distributed about the periphery of said central opening, housing orienting lugs depending from the second face of said base each being received in a respective one of said openings, said spring arm and said contact tails projecting beyond said lugs.

10. A connector as claimed in claim 9, wherein each opening in said bottom wall is in the form of a notch debouching into said central opening and having a base end remote therefrom, an elongate soldering tab depending from the base end of at least one of said notches and engaging a respective one of said spring arms and urging it radially inwardly of the connector.

11. A connector as claimed in claim 9, wherein the dielectric housing is press fitted into the circular seat and has external projections engaging its inner periphery, and a rib engaging in a flared mouth of the circular seat.

12. An outer metal shield for receiving a dielectric housing, said shield comprising;

a planar bottom wall defining a central opening;

a side wall upstanding from and extending about the outer periphery of the bottom wall for shielding the dielectric housing, the bottom wall being formed with a plurality of notches spaced about its radially inner periphery and each notch having a base proximate to the circular side wall; and an elongate soldering tab projecting from the base of each notch radially inwardly of the circular side wall and being capable of being bent out of the plane of the bottom wall in a direction away from the circular side wall.

13. A shield as claimed in claim 12, wherein each notch has a radially outer rectilinear portion on either side of the soldering tab projecting from the base of the notch, said radially outer portions being of different widths, each notch having a radially inner portion on either side of said tab, the radially inner portions being of equal width.

14. A shield as claimed in claim 12, wherein the circular wall has a radially outwardly flared mouth remote from the bottom wall, for guiding said dielectric housing into said outer shield.

15. A shield as claimed in claim 14, wherein said mouth is surrounded by a radially outwardly projecting rim formed with a planar ear projecting radially outwardly of the outer shield parallel to the bottom wall and having a tapped, through opening therein.

16. A multiply orientable shielded electrical connector for mounting on a circuit board, comprising:

an electrically conductive shield having a multiply sided aperture defining wall means;

a dielectric housing having at least one terminal secured therein, said at least one terminal adapted to pass through said aperture, said housing having a protrusion having walls, said protrusion adapted to be received in said aperture with said walls engageable with said wall means to provide multiple orientations of the housing relative to the shield.

17. A multiply orientable shielded electrical connector as recited in claim 16, wherein the aperture is a geometric shape.

* * * * *